US007052415B2

(12) United States Patent
Sasaki et al.

(10) Patent No.: US 7,052,415 B2
(45) Date of Patent: May 30, 2006

(54) GOLF BALL

(75) Inventors: Takashi Sasaki, Kobe (JP); Takahiro Sajima, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 11/020,093

(22) Filed: Dec. 27, 2004

(65) Prior Publication Data

US 2005/0187038 A1 Aug. 25, 2005

(30) Foreign Application Priority Data

Feb. 23, 2004 (JP) ..... 2004-045597

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS 4,813,677 A 3/1989 Oka et al.
5,735,757 A 4/1998 Moriyama
5,803,831 A * 9/1998 Sullivan et al. ..... 473/374
6,346,053 B1 2/2002 Inoue et al.
2004/0102259 A1* 5/2004 Ohama et al. ..... 473/378
2004/0142771 A1* 7/2004 Sajima et al. ..... 473/378
2004/0214663 A1* 10/2004 Sajima et al. ..... 473/378

FOREIGN PATENT DOCUMENTS

JP 2002-191721 A 7/2002

* cited by examiner

*Primary Examiner*—Raeann Gorden
(74) *Attorney, Agent, or Firm*—Birch, Stewart, Kolasch & Birch

(57) ABSTRACT

Golf ball has a core, a cover, and numerous dimples 12 formed on the surface of this cover. Principal component of the cover is a polyurethane elastomer. This cover has a Shore D hardness of 30 or greater and 55 or less. Occupation ratio Y of total area of the dimples 12 to surface area of a phantom sphere is equal to or greater than 75%. Proportion of the number NL of the dimples 12 having a diameter of equal to or greater than 3.90 mm to total number N of the dimples 12 is equal to or greater than 75%. Proportion of the number ML of dimples having a diameter of equal to or greater than 3.90 mm, having (Re/Rw) of 0.5 or greater and 1.5 or less, and having Re of 2.0 mm or greater and 5.0 mm or less to the number NL is equal to or greater than 50%.

4 Claims, 4 Drawing Sheets

2
B
D
B
B
B
C
B
B
C
B
B
B

GOLF BALL

This application claims priority on Patent Application No. 2004-45597 filed in Japan on Feb. 23, 2004, the entire contents of which are hereby incorporated by reference.

BACKGROUND OF THE INVENTION

1. Field of the Invention

The present invention relates to golf balls. More particularly, the present invention relates to golf balls having a core and a cover, with dimples formed on the cover.

2. Description of the Related Art

General golf balls have a core and a cover. There exist the cores composed of a single solid rubber layer, those composed of two or more solid rubber layers, those composed of a solid rubber layer and a synthetic resin layer, and the like. Dimples are formed on the surface of the cover.

Flight performances are important to golf balls. In light of the flight performance, a variety of disposals have been made with respect to shape of the dimples. U.S. Pat. No. 5,735,757 discloses a golf ball having double radius dimples with a predetermined shape. U.S. Pat. No. 6,346,053 discloses a golf ball with edge angle and curvature radius set to fall within a predetermined range.

Density of dimples (referred to as "occupation ratio") also affects the flight performance. Golf balls having a great occupation ratio are excellent in the flight performance. U.S. Pat. No. 4,813,677 discloses a golf ball having dimples densely arranged such that any novel dimple having an area that is greater than the average area can not be formed.

Spin performances are also important to golf balls. Great back spin rate results in small run (a distance from the fall point of a golf ball to the point where it stopped). For golf players, golf balls which are liable to be spun backwards are apt to be rendered to stop at a target point. When side spin rate is great, the golf ball is liable to curve. For golf players, golf balls which are liable to be side spun are apt to be rendered to intentionally curve. Golf balls that are excellent in spin performances are excellent in control performances. Senior golf players particularly place great importance on control performances upon impact with a short iron. JP-A-2002-191721 discloses a golf ball having an improved control performance through using a soft polyurethane elastomer for the cover.

At the impact between a golf ball and a golf club, the surface of the golf ball is scuffed by the face line of the golf club. Nap is thereby raised on the surface of the golf ball. Thus resulting nap markedly deteriorates the appearance of the golf ball. Force is liable to converge in the vicinity of the edge of a dimple, where the nap is readily raised. The nap shall remain along the contour of the dimple.

According to golf balls having a great occupation ratio of the dimples, area of the land shall be small. The place where a golf club comes into contact upon impact is a land. Because golf balls having a great occupation ratio have a small substantial contact area upon impact, a great force is applied against the land. According to golf balls with a great occupation ratio Y, raising of the nap is liable to be caused. There is an urgent need to suppress deterioration of the appearance resulting from the nap, in golf balls having a great occupation ratio.

Physical strength of a polyurethane elastomer is great. Covers in which this polyurethane elastomer is used are excellent in a scuff resistance performance. Although use of the polyurethane elastomer may suppress the raising of the nap to some extent, such suppression is not sufficient.

Because the polyurethane elastomer is inferior in resilience performances, to employ this polyurethane elastomer is disadvantageous in light of the flight performance.

An object of the present invention is to provide a golf ball that is excellent in a flight performance, a scuff resistance performance and a control performance.

SUMMARY OF THE INVENTION

The golf ball according to the present invention has a core, a cover, and numerous dimples formed on the surface of this cover. This cover contains a polyurethane elastomer as a principal component. This cover has a Shore D hardness of 30 or greater and 55 or less. Occupation ratio Y of total area of dimples to surface area of a phantom sphere of the golf ball is equal to or greater than 75%. Proportion of the number NL of dimples having a diameter of equal to or greater than 3.90 mm to total number N of the dimples is equal to or greater than 75%. Proportion of the number ML of dimples having a diameter of equal to or greater than 3.90 mm, complying with the following formula (1) and having a radius of curvature Re of 2.0 mm or greater and 5.0 mm or less to the number NL is equal to or greater than 50%.

$$0.5 \leqq Re/Rw \leqq 1.5 \quad (1)$$

In the formula (1), Re represents a radius of curvature of a curved surface between a dimple edge and a point positioned downward from the dimple edge by the depth of 10% in an in-depth direction. In the formula (1), Rw represents a radius of curvature of a curved surface between a point positioned downward from the dimple edge by the depth of 20% in an in-depth direction and a point positioned downward from the dimple edge by the depth of 50% in an in-depth direction.

Preferably, the proportion of the number ML to the number NL is 100%. Preferably, the proportion of the number M of the dimples complying with the formula (1) to the total number N is equal to or greater than 90%.

Preferably, the core has a center, and a mid layer comprising a resin composition. Hardness of this mid layer is greater than the hardness of the cover.

Because the golf ball according to the present invention has numerous dimples with a great diameter, and has a great occupation ratio Y, it is excellent in a flight performance. Because the cover of this golf ball contains a polyurethane elastomer as a principal component, and has a hardness of 30 or greater and 55 or less, this golf ball is excellent in a control performance. Although the polyurethane elastomer is disadvantageous in terms of the resilience performance, this golf ball has a great flight performance because dimples compensate for the defect. The polyurethane elastomer contributes to the scuff resistance performance. Ratio (Re/Rw) in this golf ball is greater than that in conventional golf balls. In this dimple, stress concentration hardly occurs. According to this golf ball, raising of the nap is suppressed on behalf of the polyurethane elastomer and dimples having a great ratio (Re/Rw).

DESCRIPTION OF THE PREFERRED EMBODIMENTS

The present invention is hereinafter described in detail with appropriate references to the accompanying drawing according to the preferred embodiments of the present invention.

Figure 1:
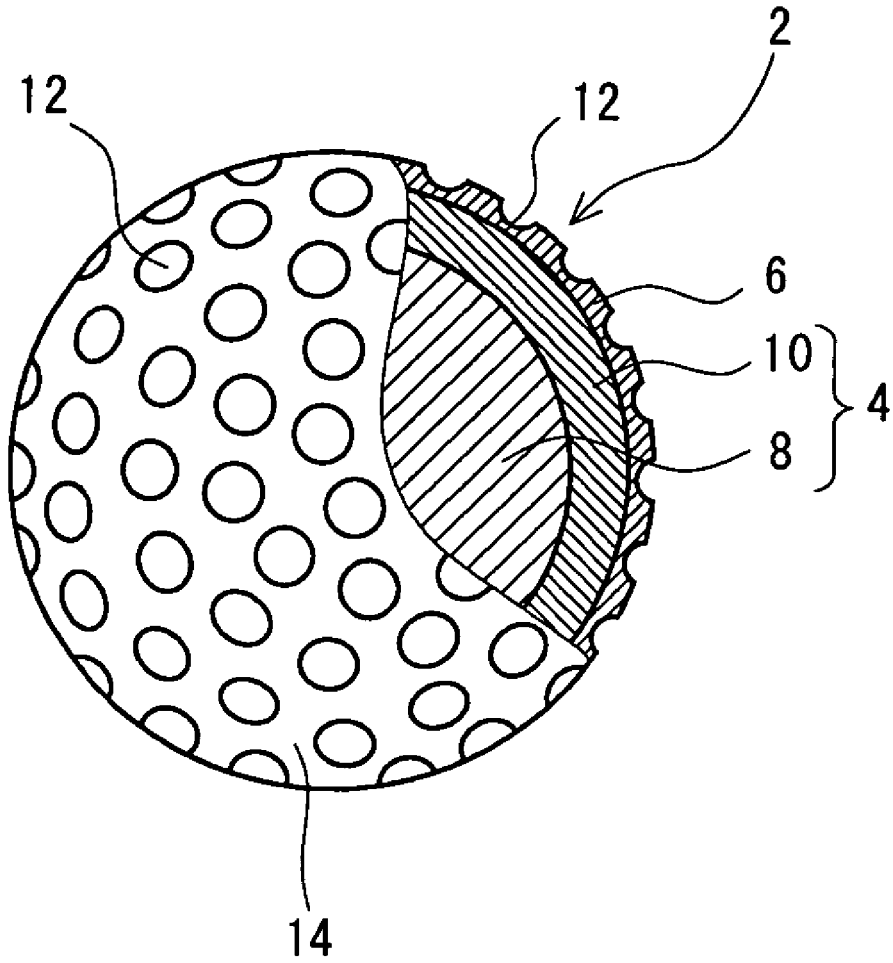
FIG. 1 is a cross-sectional view with a partially cut off part illustrating a golf ball according to one embodiment of the present invention.

Golf ball 2 shown in FIG. 1 has a spherical core 4 and a cover 6. The core 4 includes a spherical center 8 and a mid layer 10. Numerous dimples 12 are formed on the surface of the cover 6. Of the surface of the golf cover 6, parts other than the dimples 12 are lands 14. This golf ball 2 has a paint layer and a mark layer to the external side of the cover 6, although these layers are not shown in the Figure.

This golf ball 2 has a diameter of from 40 mm to 45 mm. From the standpoint of conformity to a rule defined by United States Golf Association (USGA), the diameter is preferably equal to or greater than 42.67 mm. In light of suppression of the air resistance, the diameter is preferably equal to or less than 44 mm, and more preferably equal to or less than 42.80 mm. Weight of this golf ball 2 is 40 g or greater and 50 g or less. In light of attainment of great inertia, the weight is preferably equal to or greater than 44 g, and more preferably equal to or greater than 45.00 g. From the standpoint of conformity to a rule defined by USGA, the weight is preferably equal to or less than 45.93 g.

The cover 6 herein means an outermost layer other than the paint layer and the mark layer. There exist golf balls referred to as having a cover with a two-layered structure, however, in this case, the outside layer corresponds to the cover 6 herein.

Examples of base polymer which is suitable for the cover 6 include thermoplastic or thermosetting polyurethane elastomers. Thermoplastic polyurethane elastomers which are excellent in processing characteristics and economical efficiency are particularly preferred. The thermoplastic polyurethane elastomer includes a polyurethane component as a hard segment and a polyester component or a polyether component as a soft segment. The thermoplastic polyurethane elastomer contributes to the control performance of the golf ball 2. Further, the thermoplastic polyurethane elastomer also contributes to the scuff resistance performance of the cover 6.

Illustrative examples of curing agent for the polyurethane component include alicyclic diisocyanates, aromatic diisocyanates and aliphatic diisocyanates. Particularly, alicyclic diisocyanates are preferred. Because an alicyclic diisocyanate has no double bond in its main chain, yellowing of the cover 6 may be suppressed. In addition, because an alicyclic diisocyanate is excellent in strength, scratches of the cover 6 may be suppressed. Two or more kinds of diisocyanates may be used together.

Illustrative examples of the alicyclic diisocyanate include 4,4'-dicyclohexylmethane diisocyanate ($H_{12}$MDI), 1,3-bis (isocyanatomethyl)cyclohexane ($H_6$XDI), isophorone diisocyanate (IPDI) and trans-1,4-cyclohexane diisocyanate (CHDI). In light of general-purpose properties and processing characteristics, $H_{12}$MDI is preferred. Specific examples of the thermoplastic polyurethane elastomer including $H_{12}$MDI as a constituent component include trade name "Elastolan XNY90A", trade name "Elastolan XNY97A" and trade name "Elastolan XNY585" of BASF Japan Ltd.

Illustrative examples of the aromatic diisocyanate include 4,4'-diphenylmethane diisocyanate (MDI) and toluene diisocyanate (TDI). Illustrative examples of the aliphatic diisocyanate include hexamethylene diisocyanate (HDI).

Other synthetic resin may be used together with the thermoplastic polyurethane elastomer, as the base polymer for use in the cover 6. When other synthetic resin is used with the thermoplastic polyurethane elastomer in combination, thermoplastic polyurethane elastomer is included as a principal component, in light of the control performance and scuff resistance performance. Proportion of the thermoplastic polyurethane elastomer occupying total base polymer is preferably equal to or greater than 50% by weight, more preferably equal to or greater than 60% by weight, and particularly preferably equal to or greater than 70% by weight.

Illustrative examples of the synthetic resin which may be used include thermoplastic polyamide elastomers, thermoplastic polyester elastomers, thermoplastic polyolefin elastomers, thermoplastic polystyrene elastomers and ionomer resins. A synthetic resin having a polar group such as a carboxyl group, a glycidyl group, a sulfone group, an epoxy group or the like may also be used. In particular, thermoplastic polyamide elastomers are preferred. A thermoplastic polyamide elastomer is excellent in compatibility with a thermoplastic polyurethane elastomer. The thermoplastic polyamide elastomer also contributes to the resilience performance of the golf ball 2. When a thermoplastic polyurethane elastomer and a thermoplastic polyamide elastomer are used together, weight ratio of both components is preferably 70/30 or greater and 95/5 or less.

General thermoplastic polyamide elastomers include a polyamide component as a hard segment, and a polyester component or a polyether component as a soft segment. Suitable soft segment is a polyether component. Specific examples of suitable thermoplastic polyamide elastomer include trade name "Pevax 5533" and trade name "Pevax 4033" of ATOFINA Japan K,K,.

In the cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. The cover 6 may be blended with powder of a highly dense metal such as tungsten, molybdenum or the like for the purpose of adjusting specific gravity.

Hardness Hc of the cover 6 is 30 or greater and 55 or less. In other words, the cover 6 is soft. By employing a soft cover 6, a contact time period and a contact area between the golf ball 2 and a club face upon impact with a golf club are increased. Aspin performance of the golf ball 2 is thereby improved, leading to the improvement of a control performance. In this respect, the hardness Hc of the cover 6 is more preferably equal to or less than 52, and particularly preferably equal to or less than 50. When the hardness Hc of the cover 6 is too low, the resilience performance of the golf ball 2 becomes insufficient. Therefore, the hardness Hc is more preferably equal to or greater than 35, and particularly preferably equal to or greater than 40.

In the present invention, the hardness of the cover 6 and the mid layer 10 is measured in accordance with a standard of "ASTM-D 2240-68". For the measurement, an automated rubber hardness scale which is equipped with a Shore D type spring hardness scale (trade name "LA1", available from Koubunshi Keiki Co., Ltd.) is used. For the measurement, a sheet which is formed by hot press is used having a thickness of about 2 mm and consisting of the same material as the cover 6 (or mid layer 10). Prior to the measurement, the sheet is stored at a temperature of 23° C. for two weeks. Upon the measurement, three sheets are overlaid.

It is preferred that the cover 6 has a thickness of 0.2 mm or greater and 2.0 mm or less. When the thickness is less than the above range, the control performance and durability of the golf ball 2 may become insufficient. In this respect, the thickness is more preferably equal to or greater than 0.3 mm, and particularly preferably equal to or greater than 0.5 mm. When the thickness is beyond the above range, the resilience performance and the flight performance of the golf ball 2 may become insufficient. In this respect, the thickness is more preferably equal to or less than 1.8 mm, and particularly preferably equal to or less than 1.5 mm.

Figure 2:
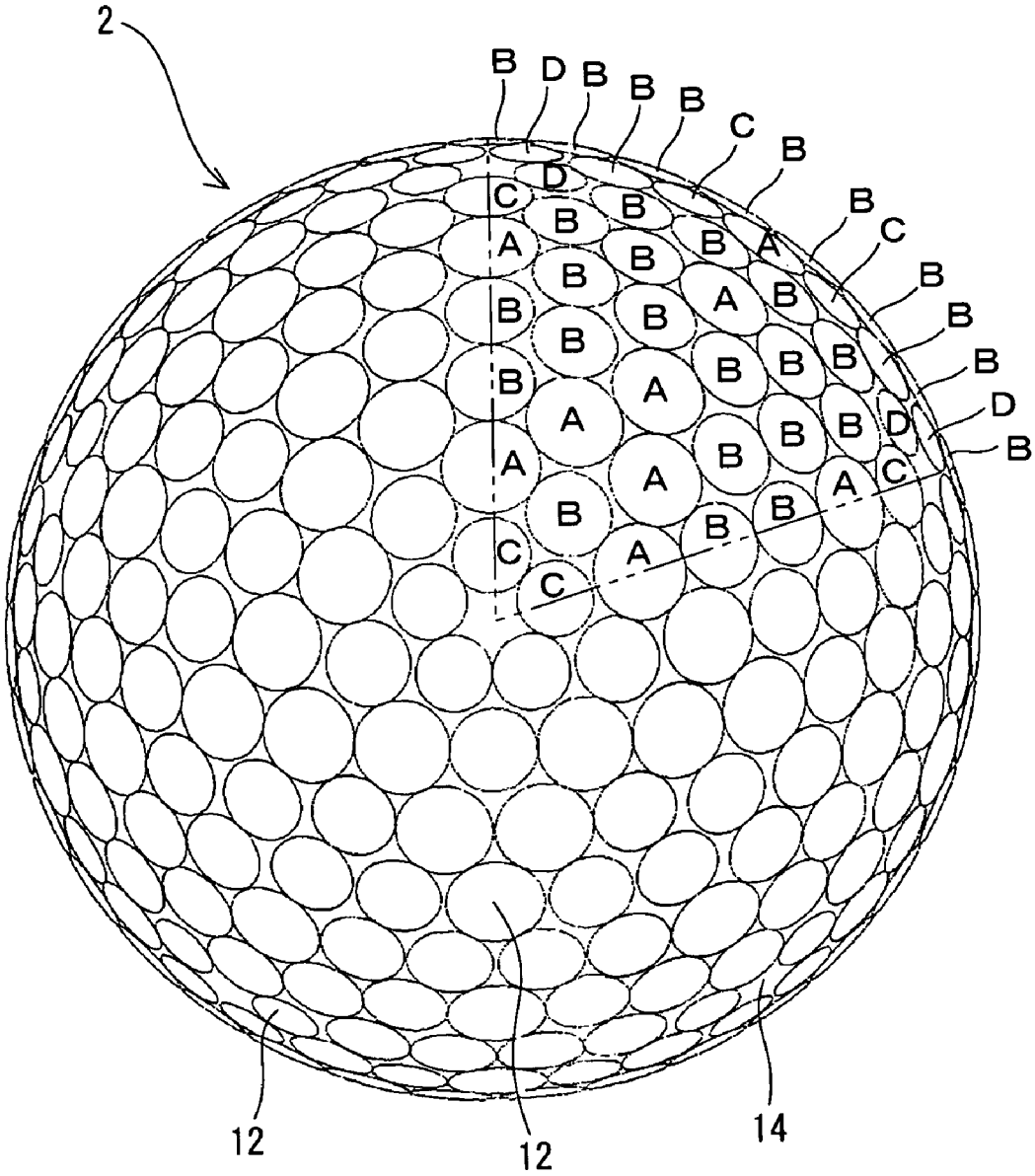
FIG. 2 is an enlarged plan view illustrating the golf ball shown in FIG. 1.

FIG. 2 is an enlarged plan view illustrating the golf ball 2 shown in FIG. 1. As is clear from FIG. 2, plane shape of all the dimples 12 is circular. In FIG. 2, kinds of the dimples 12 are illustrated by symbols A to D for one unit which is provided by dividing the surface of the golf ball 2 into 10 equivalent units. This golf ball 2 includes dimples A having a diameter of 4.35 mm, dimples B having a diameter of 3.90 mm, dimples C having a diameter of 3.40 mm, and dimples D having a diameter of 3.20 mm. Number of the dimple A is 70; number of the dimple B is 260; number of the dimple C is 40; and number of the dimple D is 40. Total number of the dimples 12 of this golf ball 2 is 410.

In this golf ball 2, occupation ratio Y of total area of the dimples 12 to surface area of the phantom sphere is equal to or greater than 75%. When the occupation ratio Y is less than the above range, the flight performance of the golf ball 2 may become insufficient. In this respect, the occupation ratio Y is more preferably equal to or greater than 76%, and particularly preferably equal to or greater than 77%. When the occupation ratio Y is excessive, the dimple 12 may interfere with other dimple 12. In this respect, the occupation ratio Y is preferably equal to or less than 90%, more preferably equal to or less than 88%, and particularly preferably equal to or less than 87%.

Area of the dimple 12 is an area of a region surrounded by the edge line when the center of the golf ball 2 is viewed at infinity (i.e., an area of the plane shape). In case of the dimple 12 having a plane shape of circular and a diameter of Di, the area s is calculated by the following formula:

$$s=(Di/2)^2*\pi.$$

In the golf ball 2 shown in FIG. 2, the area of the dimple A is 14.862 $mm^2$; the area of the dimple B is 11.946 $mm^2$; the area of the dimple C is 9.079 $mm^2$; and the area of the dimple D is 8.042 $mm^2$. Total area of these dimples 12 is 4831.1 $mm^2$. Occupation ratio is calculated by dividing this total area by the surface area of the phantom sphere. In this golf ball 2, the occupation ratio is 84%.

Figure 3:
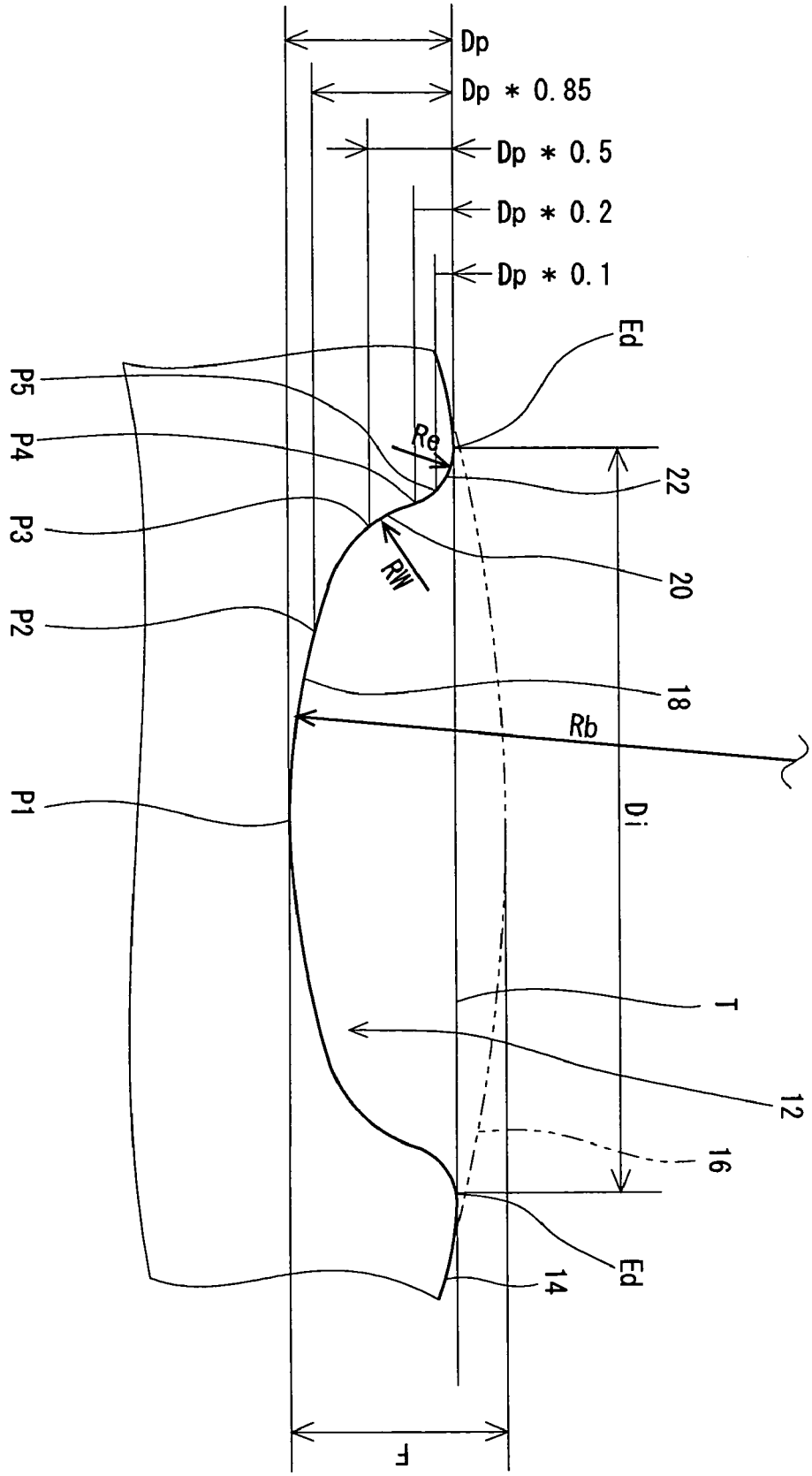
FIG. 3 is an enlarged cross-sectional view illustrating a part of the golf ball shown in FIG. 1.

FIG. 3 is an enlarged cross-sectional view illustrating a part of the golf ball 2 shown in FIG. 1. In this Figure, a cross-section is illustrated which passes through the deepest site of the dimple 12 and the center of the golf ball 2. Vertical direction in FIG. 3 is an in-depth direction of the dimple 12. The in-depth direction is a direction heading from the center of gravity on the area of the dimple 12 toward the center of the golf ball 2. What is indicated by a chain double-dashed line in FIG. 3 is a phantom sphere. The surface of the phantom sphere is a surface of the golf ball 2 to be present when it is postulated that no dimple 12 exists. The dimple 12 is recessed from the phantom sphere. The land 14 agrees with the phantom sphere.

What is indicated by a both-sided arrowhead Di in FIG. 3 is the diameter of the dimple 12. This diameter Di is a distance between one contact point Ed and another contact point Ed when a tangent line T that is common to both sides of the dimple 12 is depicted. The contact points Ed also constitute the edge of the dimple 12. The edge Ed defines the plane shape of the dimple 12. What is indicated by a symbol P1 in FIG. 3 is the deepest part of the dimple 12. The distance between the tangent line T and the deepest part P1 is the depth Dp of the dimple 12.

What is indicated by a symbol P2 in FIG. 3 is a point positioned downward from the edge Ed by the distance of (Dp*0.85). What is indicated by a symbol P3 is a point positioned downward from the edge Ed by the distance of (Dp*0.5). What is indicated by a symbol P4 is a point positioned downward from the edge Ed by the distance of (Dp*0.2). What is indicated by a symbol P5 is a point positioned downward from the edge Ed by the distance of (Dp*0.1).

The dimple 12 comprises a bottom curved face 18, a side wall curved face 20 and an edge neighboring curved face 22. The bottom curved face 18 is bowl-shaped, and the side wall curved face 20 and the edge neighboring curved face 22 are ring-shaped. The bottom curved face 18 is situated lower than the point P2. The bottom curved face 18 includes the deepest part P1. The side wall curved face 20 is situated between the point P3 and the point P4. The edge neighboring curved face 22 is situated upper than the point P5. The bottom curved face 18 is inwardly convex in its entirety. The side wall curved face 20 is inwardly convex in its entirety. The edge neighboring curved face 22 is outwardly convex in its entirety.

Radius of curvature Rb of the bottom curved face 18 is a radius of a circular arc provided when a circular arc is envisioned to pass through three points, i.e., the point P2 shown in FIG. 3; other point P2 positioned opposite to this point P2 with the deepest part P1 interposed therebetween; and the deepest part P1. The radius of curvature Rw of the side wall curved face 20 is a radius of a circular arc provided when a circular arc is envisioned to pass through three points, i.e., the point P3; a point positioned downward from the edge Ed by the distance of (Dp*0.35); and the point P4. The radius of curvature Re of the edge neighboring curved face 22 is a radius of a circular arc provided when a circular arc is envisioned to pass through three points, i.e., the point P5; a point positioned downward from the edge Ed by the distance of (Dp*0.05); and the edge Ed.

The dimple 12 shown in FIG. 3 complies with the above-described formula (1). In other words, the ratio (Re/Rw) is equal to or greater than 0.5 in this dimple 12. According to general golf balls 2 in prior arts, the ratio (Re/Rw) is equal to or less than 0.2. The ratio (Re/Rw) according to the golf ball 2 shown in FIG. 3 is great. In other words, the radius of curvature Re is comparatively great, while the radius of curvature Rw is comparatively small in this dimple 12. On behalf of the great radius of curvature Re, convergence of force at impact onto the edge neighboring curved face 22 hardly occurs. According to the golf ball 2 having this type of dimple 12, raising of the nap is suppressed in spite of formation of a large number of dimples 12 having a great occupation ratio Y and having a great diameter. Because the radius of curvature Rw of the side wall curved face 20 is small, the angle of gradient with respect to the phantom sphere is great for this side wall curved face 20. This side wall curved face 20 exerts an excellent effect in disturbing the flow of air. Although the edge neighboring curved face 22 having a great radius of curvature Re exerts an inferior effect in disturbing the flow of air, the side wall curved face 20 compensates for the edge neighboring curved face 22 in connection with the flight performance. According to the golf ball 2 having this type of dimple 12, deterioration of the appearance due to the nap hardly occurs, and the flight performance is maintained. In light of the achievement in both terms of the appearance and the flight performance, the ratio (Re/Rw) is more preferably equal to or greater than 0.6, and particularly preferably equal to or greater than 0.7.

Because too great ratio (Re/Rw) results in a hopping trajectory, the ratio (Re/Rw) is set to be equal to or less than 1.5. It is preferred that the ratio (Re/Rw) is equal to or less than 1.3, still more equal to or less than 1.2, and yet more equal to or less than 1.1.

In light of the suppression of raising of the nap, the radius of curvature Re of the edge neighboring curved face 22 is set to be equal to or greater than 2.0 mm. The radius of curvature Re is more preferably equal to or greater than 2.2 mm, and particularly preferably equal to or greater than 2.4 mm. In light of the flight performance, the radius of curvature Re is set to be equal to or less than 5.0 mm. The radius of curvature Re is more preferably equal to or less than 4.8 mm, and particularly preferably equal to or less than 4.6 mm.

In light of the suppression of raising of the nap, the radius of curvature Rw of the side wall curved face 20 is preferably equal to or greater than 1.0 mm, more preferably equal to or greater than 2.0 mm, and particularly preferably equal to or greater than 3.0 mm. In light of the flight performance, the radius of curvature Rw is preferably equal to or less than 10.0 mm, more preferably equal to or less than 9.0 mm, and particularly preferably equal to or less than 8.0 mm.

The number of the dimples 12 is herein shown by the following symbols:

N: total number of the dimples;

NL: number of the dimples having a diameter of equal to or greater than 3.90 mm;

M: number of the dimples that comply with the above-described formula (1); and

ML: number of the dimples having a diameter of equal to or greater than 3.90 mm, complying with the above-described formula (1) and having a radius of curvature Re of 2.0 mm or greater and 5.0 mm or less.

According to the present invention, a proportion of the number NL to the total number N is equal to or greater than 75%. In other words, the golf ball 2 according to the present invention has a large number of great dimples 12. This golf ball 2 is excellent in the flight performance. One of the grounds for the excellent flight performance of this golf ball 2 is speculated that the dimples 12 having a diameter of equal to or greater than 3.90 mm contribute to reduction of the drag at the initial stage of a trajectory. In light of the flight performance, the proportion of the number NL to the total number N is more preferably equal to or greater than 77%, and particularly preferably equal to or greater than 80%. Upper limit of this proportion is 100%.

According to the present invention, the proportion of the number ML to the number NL is equal to or greater than 50%. In other words, according to this golf ball 2, the ratio (Re/Rw) is set to be 0.5 or greater and 1.5 or less as far as possible, and the radius of curvature Re is set to be 2.0 mm or greater and 5.0 mm or less as far as possible, for the dimples having a diameter of equal to or greater than 3.90 mm. Deterioration of the appearance of the golf ball 2 is thereby suppressed. It is preferred that the proportion of the number ML to the number NL is equal to or greater than 70%, still more equal to or greater than 85%, and even more equal to or greater than 90%. This proportion is ideally 100%.

According to the present invention, the proportion of the number M to the total number N is preferably equal to or greater than 90%. In other words, the ratio (Re/Rw) is set to be 0.5 or greater and 1.5 or less as far as possible, irrespective of the diameter of the dimples 12.

Deterioration of the appearance of the golf ball 2 is thereby suppressed. The proportion of the number M to the total number N is more preferably equal to or greater than 95%. This proportion is ideally 100%.

The radius of curvature Rb of the bottom curved face 18 is determined ad libitum to fall within the range such that the optimum dimple volume is obtained. The radius of curvature Rb is usually 5 mm or greater and 40 mm or less.

What is indicated by a both-sided arrowhead F in FIG. 3 is a distance between the phantom sphere and the deepest part P1. It is preferred that the distance F is 0.10 mm or greater and 0.60 mm or less. When the distance F is less than the above range, a hopping trajectory may be provided. In this respect, the distance F is more preferably equal to or greater than 0.125 mm, and particularly preferably equal to or greater than 0.14 mm. When the distance F is beyond the above range, a dropping trajectory may be provided. In this respect, the distance F is more preferably equal to or less than 0.55 mm, and particularly preferably equal to or less than 0.50 mm.

In FIG. 3, volume surrounded by the phantom sphere and the dimple 12 is the volume of the dimple 12. It is preferred that total volume of the dimples 12 is 300 $m^3$ or greater and 700 $mm^3$ or less. When the total volume is less than the above range, a hopping trajectory may be provided. In this respect, the total volume is more preferably equal to or greater than 350 $mm^3$, and particularly preferably equal to or greater than 400 $mm^3$. When the total volume is beyond the above range, a dropping trajectory may be provided. In this respect, the total volume is more preferably equal to or less than 650 $mm^3$, and particularly preferably equal to or less than 600 $mm^3$.

In the golf ball 2 shown in FIG. 1 to FIG. 3, the volume of the dimple A is 1.793 $mm^3$; the volume of the dimple B is 1.311 $mm^3$; the volume of the dimple C is 0.899 $mm^3$; and the volume of the dimple D is 0.754 $mm^3$. Total volume of the dimples 12 in this golf ball 2 is 532.4 $mm^3$.

It is preferred that total number N of the dimples 12 is 200 or greater and 500 or less. When the total number N is less than the above range, improvement of lift force and reduction of drag on behalf of the dimple may become insufficient. In this respect, the total number N is more preferably equal to or greater than 230, and particularly preferably equal to or greater than 260. When the total number N is beyond the above range, improvement of lift force and reduction of drag on behalf of the dimple may become insufficient resulting from small size of the individual dimples 12. In this respect, the total number N is more preferably equal to or less than 470, and particularly preferably equal to or less than 440.

The dimples 12 to be formed may be of a single type, or may be of multiple types. In stead of the circular dimples, or together with the circular dimples, non-circular dimples (dimples having the plane shape which is not circular) may be also formed. Specific examples of the non-circular dimple include polygonal dimples, elliptical dimples, oval dimples and egg-shaped dimples. In cases of the non-circular dimple, four cross sections are selected through dividing the dimple every 45°, then the radii of curvature Rb, Rw and Re as well as the distance F are measured for these cross sections. Thus resulting data are averaged.

Specifications of the dimples such as the radius of curvature, diameter Di, depth Dp, distance F, volume and the like are determined by actual measurement of the golf ball 2. The radius of curvature Re of the edge neighboring curved face 22 is measured at a site that is adjacent to the land 14 having a sufficient size.

The center 8 is usually obtained through crosslinking of a rubber composition. Examples of a preferable base rubber include polybutadienes, polyisoprenes, styrene-butadiene copolymers, ethylene-propylene-diene copolymers and natural rubbers. In light of the resilience performance, polybutadienes are preferred. In the case where other rubber is used together with a polybutadiene, to employ a polybutadiene as a principal component is preferred. Specifically, it is preferred that a proportion of polybutadiene occupying the entire base rubber be equal to or greater than 50% by weight, and particularly equal to or greater than 80% by weight. Polybutadienes having a percentage of the cis-1,4 bond of equal to or greater than 40%, and particularly equal to or greater than 80% are particularly preferred.

For crosslinking of the center 8, a co-crosslinking agent is usually used. Preferable co-crosslinking agent in light of the resilience performance is a monovalent or bivalent metal salt of an α,β-unsaturated carboxylic acid having 2 to 8 carbon atoms. Specific examples of preferable co-crosslinking agent include zinc diacrylate, magnesium diacrylate, zinc dimethacrylate and magnesium dimethacrylate. Zinc diacrylate and zinc dimethacrylate are particularly preferred on the ground that an excellent resilience performance can be achieved.

As the co-crosslinking agent, an α,β-unsaturated carboxylic acid having 2 to 8 carbon atoms, and a metal oxide may be also blended. Both components react in the rubber composition to give a salt. This salt contributes to a crosslinking reaction. Examples of preferable α,β-unsaturated carboxylic acid include acrylic acid and methacrylic acid. Examples of preferable metal oxide include zinc oxide and magnesium oxide.

The amount of the co-crosslinking agent to be blended is preferably 10 parts by weight or greater and 50 parts by weight or less per 100 parts by weight of the base rubber. When the amount is less than the above range, the resilience performance of the golf ball 2 may become insufficient. In this respect, the amount is more preferably equal to or greater than 15 parts by weight. When the amount is beyond the above range, a hard feel at impact of the golf ball 2 may be experienced. In this respect, the amount is more preferably equal to or less than 45 parts by weight.

In the rubber composition for use in the center 8, an organic peroxide may be preferably blended together with the co-crosslinking agent. The organic peroxide serves as a crosslinking initiator. By blending the organic peroxide, the resilience performance of the golf ball 2 may be improved. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

The amount of the organic peroxide to be blended is preferably 0.1 part by weight or greater and 3.0 parts by weight or less per 100 parts by weight of the base rubber. When the amount is less than the above range, the resilience performance of the golf ball 2 may become insufficient. In this respect, the amount is more preferably equal to or greater than 0.3 part by weight, and particularly preferably equal to or greater than 0.5 part by weight. When the amount is beyond the above range, a hard feel at impact of the golf ball 2 may be experienced. In this respect, the amount is more preferably equal to or less than 2.5 parts by weight.

In the center 8 may be blended a filler for the purpose of adjusting specific gravity and the like. Illustrative examples of suitable filler include zinc oxide, barium sulfate, calcium carbonate and magnesium carbonate. Powder consisting of a highly dense metal may be also blended as a filler. Specific examples of the highly dense metal include tungsten and molybdenum. The amount of the filler to be blended is determined ad libitum so that the intended specific gravity of the center 8 can be accomplished. Particularly preferable filler is zinc oxide. Zinc oxide serves not only as a mere agent for adjusting specific gravity but also as a crosslinking activator. Various kinds of additives such as sulfur, a sulfur compound, an anti-aging agent, a coloring agent, a plasticizer, a dispersant and the like may be blended in an appropriate amount to the center 8 as needed. The center 8 may be also blended with crosslinked rubber powder or synthetic resin powder.

The center 8 has a diameter of 25 mm or greater and 41 mm or less. Crosslinking temperature of the center 8 is usually 140° C. or greater and 180° C. or less. Crosslinking time period of the center 8 is usually 10 minutes or longer and 60 minutes or less.

The mid layer 10 may be composed of a crosslinked rubber, or may be composed of a resin composition. When it is composed of a crosslinked rubber, the base rubber thereof may be similar to the base rubber for use in the center 8 as described above. Also, a similar co-crosslinking agent and organic peroxide to those which may be blended in the center 8 as described above can be blended. The amount of the co-crosslinking agent to be blended is preferably 15 parts by weight or greater and 50 parts by weight or less per 100 parts by weight of the base rubber. When the amount is less than the above range, the resilience performance of the golf ball 2 may become insufficient. In this respect, the amount is more preferably equal to or greater than 20 parts by weight. When the amount is beyond the above range, the feel at impact of the golf ball 2 may be deteriorated. In this respect, the amount is more preferably equal to or less than 45 parts by weight, and particularly preferably equal to or less than 40 parts by weight.

The amount of the organic peroxide to be blended in the mid layer 10 is preferably 0.1 part by weight or greater and 6.0 parts by weight or less per 100 parts by weight of the base rubber. When the amount is less than the above range, the resilience performance of the golf ball 2 may become insufficient. In this respect, the amount is more preferably equal to or greater than 0.3 part by weight, and particularly preferably equal to or greater than 0.5 part by weight. When the amount is beyond the above range, a hard feel at impact of the golf ball 2 may be experienced. In this respect, the amount is more preferably equal to or less than 5.0 parts by weight, and particularly preferably equal to or less than 4.0 parts by weight. Also in the mid layer 10 may be blended a similar filler and various kinds of additives to those which may be blended in the center 8 as described above.

When the mid layer 10 is composed of a resin composition, examples of suitable base polymer include ionomer resins, thermoplastic polyester elastomers, thermoplastic polyamide elastomers, thermoplastic polyurethane elastomers, thermoplastic polyolefin elastomers and thermoplastic polystyrene elastomers. Two or more kinds of synthetic resins may be used together. In light of the resilience performance of the golf ball 2, ionomer resins are preferred.

Of the ionomer resins, copolymers of α-olefin and an α,β-unsaturated carboxylic acid having 3 to 8 carbon atoms in which a part of the carboxylic acid is neutralized with a metal ion are suitable. Preferable α-olefin is ethylene and propylene. Preferable α,β-unsaturated carboxylic acid is acrylic acid and methacrylic acid. Illustrative examples of the metal ion for use in the neutralization include sodium ion, potassium ion, lithium ion, zinc ion, calcium ion, magnesium ion, aluminum ion and neodymium ion. The neutralization may also be carried out with two or more kinds of the metal ions. In light of the resilience performance and durability of the golf ball 2, particularly suitable metal ions are sodium ion, zinc ion, lithium ion and magnesium ion.

In the mid layer 10 may be blended a filler for the purpose of adjusting specific gravity and the like. Illustrative examples of suitable filler include zinc oxide, barium sulfate, calcium carbonate and magnesium carbonate. Powder consisting of a highly dense metal may be also blended as a filler. Specific examples of the highly dense metal include tungsten and molybdenum. The amount of the filler to be blended is determined ad libitum so that the intended specific gravity of the mid layer 10 can be accomplished. The mid layer 10 maybe also blended with a coloring agent, crosslinked rubber powder or synthetic resin powder.

Thickness of the mid layer 10 is preferably 0.5 mm or greater and 4.0 mm or less. When the thickness is less than the above range, the resilience performance of the golf ball 2 may become insufficient. In this respect, the thickness is more preferably equal to or greater than 0.7 mm. When the thickness is beyond the above range, the feel at impact of the golf ball 2 may become insufficient. In this respect, the thickness is more preferably equal to or less than 3.0 mm, and particularly preferably equal to or less than 2.0 mm.

Hardness Hm of the mid layer 10 is preferably equal to or greater than 55. This mid layer 10 contributes to the resilience performance of the golf ball 2. In light of the resilience performance, the hardness Hm is more preferably equal to or greater than 58, and particularly preferably equal to or greater than 60. When the hardness Hm is extremely high, the feel at impact of the golf ball 2 may become insufficient. In this respect, the hardness Hm is preferably equal to or less than 70, and more preferably equal to or less than 65.

Difference (Hm−Hc) between the hardness Hm of the mid layer 10 and the hardness Hc of the cover 6 is preferably equal to or greater than 5. The resilience performance of the golf ball 2 is thereby improved. In this respect, the difference of hardness (Hm−Hc) is more preferably equal to or greater than 8, and particularly preferably equal to or greater than 10. When the difference of hardness (Hm−Hc) is extremely great, the feel at impact of the golf ball 2 may become insufficient. In this respect, the difference of hardness (Hm−Hc) is preferably equal to or less than 40, more preferably equal to or less than 35, and particularly preferably equal to or less than 30.

Although the center 8 of the golf ball 2 depicted in FIG. 1 is composed of a single layer, a center composed of two or more layers may be also employed. Another mid layer may be provided between the center 8 and the mid layer 10. The golf ball may be composed of a core of a single layer and cover.

EXAMPLES

Specifications of a center, a mid layer, a cover and dimples were defined as presented in Table 1 and Table 2 below, and golf balls of Examples 1 to 8 and Comparative Examples 1 to 7 were obtained. Diameter of these golf balls is 42.7 mm. Details of composition of the center, the mid layer and the cover are presented in Table 3; and details of secifications of the dimples are presented in Table 4 and Table 5.

TABLE 1

| | | Specification of golf ball | | | | | | | |
|---|---|---|---|---|---|---|---|---|---|
| | | Example 1 | Example 2 | Example 3 | Example 4 | Example 5 | Example 6 | Example 7 | Example 8 |
| Center | Composition type | a | a | a | a | a | a | a | b |
| | Diameter (mm) | 37.5 | 37.5 | 34.1 | 37.5 | 37.5 | 37.5 | 37.5 | 40.1 |
| Mid layer | Composition type | d | d | c | d | d | d | d | — |
| | Thickness (mm) | 1.3 | 1.3 | 3.0 | 1.3 | 1.3 | 1.3 | 1.3 | — |
| Cover | Composition type | e | f | f | e | e | e | e | f |
| | Thickness (mm) | 1.3 | 1.3 | 1.3 | 1.3 | 1.3 | 1.3 | 1.3 | 1.3 |
| Dimple type | | I | I | I | II | III | IV | V | I |

TABLE 2

| | | Specification of golf ball | | | | | | |
|---|---|---|---|---|---|---|---|---|
| | | Comp. Example 1 | Comp. Example 2 | Comp. Example 3 | Comp. Example 4 | Comp. Example 5 | Comp. Example 6 | Comp. Example 7 |
| Center | Composition type | a | a | a | a | a | a | a |
| | Diameter (mm) | 37.5 | 37.5 | 37.5 | 37.5 | 37.5 | 37.5 | 37.5 |
| Mid layer | Composition type | d | d | d | d | d | d | d |
| | Thickness (mm) | 1.3 | 1.3 | 1.3 | 1.3 | 1.3 | 1.3 | 1.3 |
| Cover | Composition type | g | h | e | e | e | e | e |
| | Thickness (mm) | 1.3 | 1.3 | 1.3 | 1.3 | 1.3 | 1.3 | 1.3 |
| Dimple type | | I | I | VI | VII | VIII | IX | X |

TABLE 3

Specification of center, mid layer and cover (parts by weight)

| | Composition type | | | | | | | |
|---|---|---|---|---|---|---|---|---|
| | a | b | c | d | e | f | g | h |
| BR11 *1 | 100 | 100 | 100 | — | — | — | — | — |
| Zinc diacrylate | 29 | 33 | 36 | — | — | — | — | — |
| Zinc oxide | 5 | 5 | 5 | — | — | — | — | — |
| Barium sulfate *2 | adequate amoount | adequate amoount | adequate amoount | — | — | — | — | — |
| Diphenyl disulfide | 0.5 | 0.5 | — | — | — | — | — | — |
| Dicumyl peroxide | 0.8 | 0.8 | 0.8 | — | — | — | — | — |
| Himilan 1605 *3 | — | — | — | 50 | — | — | 50 | 50 |
| Himilan 1706 *4 | — | — | — | 50 | — | — | — | — |
| Himilan 1557 *5 | — | — | — | — | — | — | 50 | — |
| Himilan AM7316 *6 | — | — | — | — | — | — | — | 50 |
| Elastolan XNY90A *7 | — | — | — | — | 80 | — | — | — |
| Elastolan XNY97A *8 | — | — | — | — | — | 80 | — | — |
| Pebax 5533 *9 | — | — | — | — | 20 | 20 | — | — |

TABLE 3-continued

Specification of center, mid layer and cover (parts by weight)

| | Composition type | | | | | | | |
|---|---|---|---|---|---|---|---|---|
| | a | b | c | d | e | f | g | h |
| Titanium dioxide | — | — | — | — | 4 | 4 | 4 | 4 |
| Crosslinking temperature (° C.) | 160 | 160 | 170 | — | — | — | — | — |
| Crosslinking time (min) | 20 | 20 | 15 | — | — | — | — | — |

*1 Polybutadiene available from JSR Corporation

*2 Adjusted to give the weight of the golf ball of 45.4 g

*3 Ionomer resin available from Du Pont-MITSUI POLYCHEMICALS Co., Ltd.

*4 Ionomer resin available from Du Pont-MITSUI POLYCHEMICALS Co., Ltd.

*5 Ionomer resin available from Du Pont-MITSUI POLYCHEMICALS Co., Ltd.

*6 Ionomer resin available from Du Pont-MITSUI POLYCHEMICALS Co., Ltd.

*7 Thermoplastic polyurethane elastomer available from BASF Japan Ltd.

*8 Thermoplastic polyurethane elastomer available from BASF Japan Ltd.

*9 Thermoplastic polyamide elastomer available from ATOFINA Japan K, K,

TABLE 4

Specification of dimple

Figure 4:
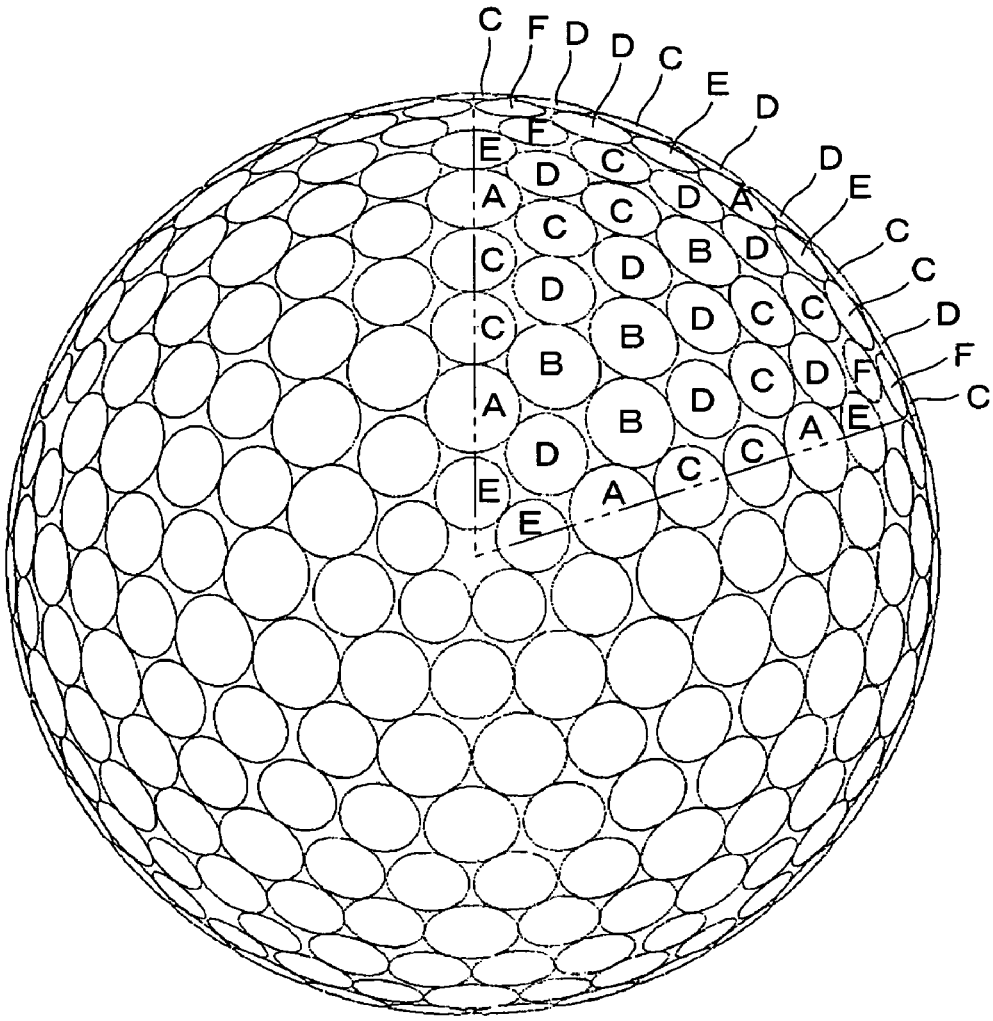
FIG. 4 is a plan view illustrating a golf ball according to Example 7 of the present invention.

| Type | Kind | Number | Di (mm) | F (mm) | Re (mm) | Rw (mm) | Re/Rw | Volume ($mm^3$) | Figure |
|---|---|---|---|---|---|---|---|---|---|
| I | A | 70 | 4.35 | 0.2196 | 3.0 | 4.0 | 0.75 | 1.793 | FIG. 2 |
| | B | 260 | 3.90 | 0.2052 | 3.0 | 4.0 | 0.75 | 1.311 | |
| | C | 40 | 3.40 | 0.1978 | 0.5 | 11.2 | 0.04 | 0.899 | |
| | D | 40 | 3.20 | 0.1870 | 0.5 | 10.1 | 0.05 | 0.754 | |
| II | A | 70 | 4.35 | 0.2181 | 3.0 | 3.0 | 1.00 | 1.793 | FIG. 2 |
| | B | 260 | 3.90 | 0.2032 | 3.0 | 3.0 | 1.00 | 1.311 | |
| | C | 40 | 3.40 | 0.1978 | 0.5 | 11.2 | 0.04 | 0.899 | |
| | D | 40 | 3.20 | 0.1870 | 0.5 | 10.1 | 0.05 | 0.754 | |
| III | A | 70 | 4.35 | 0.2181 | 3.0 | 3.0 | 1.00 | 1.793 | FIG. 2 |
| | B | 260 | 3.90 | 0.2032 | 3.0 | 3.0 | 1.00 | 1.311 | |
| | C | 40 | 3.40 | 0.1721 | 3.0 | 3.0 | 1.00 | 0.899 | |
| | D | 40 | 3.20 | 0.1590 | 3.0 | 3.0 | 1.00 | 0.754 | |
| IV | A | 70 | 4.35 | 0.2243 | 3.0 | 6.0 | 0.50 | 1.793 | FIG. 2 |
| | B | 260 | 3.90 | 0.2097 | 3.0 | 6.0 | 0.50 | 1.311 | |
| | C | 40 | 3.40 | 0.1978 | 0.5 | 11.2 | 0.04 | 0.899 | |
| | D | 40 | 3.20 | 0.1870 | 0.5 | 10.1 | 0.05 | 0.754 | |
| V | A | 50 | 4.35 | 0.2181 | 3.0 | 3.0 | 1.00 | 1.793 | FIG. 4 |
| | B | 20 | 4.35 | 0.2411 | 0.5 | 18.3 | 0.03 | 1.793 | |
| | C | 150 | 3.90 | 0.2032 | 3.0 | 3.0 | 1.00 | 1.311 | |
| | D | 110 | 3.90 | 0.2192 | 0.5 | 14.7 | 0.03 | 1.311 | |
| | E | 40 | 3.40 | 0.1978 | 0.5 | 11.2 | 0.04 | 0.899 | |
| | F | 40 | 3.20 | 0.1870 | 0.5 | 10.1 | 0.05 | 0.754 | |

TABLE 5

| Specification of dimple | | | | | | | | | |
|---|---|---|---|---|---|---|---|---|---|
| Type | Kind | Number | Di (mm) | F (mm) | Re (mm) | Rw (mm) | Re/Rw | Volume ($mm^3$) | Figure |
| VI | A | 70 | 4.35 | 0.2411 | 0.5 | 18.3 | 0.03 | 1.793 | FIG. 2 |
| | B | 260 | 3.90 | 0.2192 | 0.5 | 14.7 | 0.03 | 1.311 | |
| | C | 40 | 3.40 | 0.1978 | 0.5 | 11.2 | 0.04 | 0.899 | |
| | D | 40 | 3.20 | 0.1870 | 0.5 | 10.1 | 0.05 | 0.754 | |
| VII | A | 70 | 4.35 | 0.2164 | 1.0 | 1.0 | 1.00 | 1.793 | FIG. 2 |
| | B | 260 | 3.90 | 0.1985 | 1.0 | 1.0 | 1.00 | 1.311 | |
| | C | 40 | 3.40 | 0.1978 | 0.5 | 11.2 | 0.04 | 0.899 | |
| | D | 40 | 3.20 | 0.1870 | 0.5 | 10.1 | 0.05 | 0.754 | |
| VIII | A | 70 | 4.35 | 0.2286 | 3.0 | 9.0 | 0.33 | 1.793 | FIG. 2 |
| | B | 260 | 3.90 | 0.2179 | 3.0 | 9.0 | 0.33 | 1.311 | |
| | C | 40 | 3.40 | 0.1978 | 0.5 | 11.2 | 0.04 | 0.899 | |
| | D | 40 | 3.20 | 0.1870 | 0.5 | 10.1 | 0.05 | 0.754 | |
| IX | A | 70 | 4.35 | 0.2261 | 6.0 | 6.0 | 1.00 | 1.793 | FIG. 2 |
| | B | 260 | 3.90 | 0.2127 | 6.0 | 6.0 | 1.00 | 1.311 | |
| | C | 40 | 3.40 | 0.1978 | 0.5 | 11.2 | 0.04 | 0.899 | |
| | D | 40 | 3.20 | 0.1870 | 0.5 | 10.1 | 0.05 | 0.754 | |
| X | A | 70 | 4.35 | 0.2181 | 2.0 | 1.0 | 2.00 | 1.793 | FIG. 2 |
| | B | 260 | 3.90 | 0.2032 | 2.0 | 1.0 | 2.00 | 1.311 | |
| | C | 40 | 3.40 | 0.1721 | 0.5 | 13.9 | 0.04 | 0.899 | |
| | D | 40 | 3.20 | 0.1590 | 0.5 | 13.0 | 0.04 | 0.754 | |

[Measurement of Amount of Compressive Deformation]

The golf ball was first placed on a hard plate made of metal. Next, a cylinder made of metal was rendered to descend gradually toward the golf ball, and thus the golf ball, which was put between the bottom face of this cylinder and the hard plate, was deformed. Then, a migration distance of the cylinder was measured, starting from the state in which an initial load of 98 N was applied to the golf ball up to the state in which a final load of 1274 N was applied thereto. The results thus obtained are presented in Table 6 and Table 7 below.

[Travel Distance Test]

A driver with a metal head was equipped with a swing machine available from Golf Laboratory Co. Then the machine condition was set to give the head speed of 45 m/sec, and golf balls were hit therewith. Accordingly, travel distance (i.e., the distance from the launching point to the point where the ball stopped) was measured. Mean values of 5 times measurement are presented in Table 6 and Table 7 below.

[Evaluation of Scuff Resistance Performance]

A pitching wedge was equipped with the swing machine as described above. Then the machine condition was set to give the head speed of 36 m/sec, and golf balls were hit therewith. The surface condition of the golf ball after hitting was visually observed, and was graded into five ranks of from "A" to "E". The results are presented in Table 6 and Table 7 below.

[Evaluation of Control Performance]

Using a pitching wedge, golf balls were hit by 10 senior golf players. Thus, the control performance was evaluated. Those which were liable to be spun around and excellent in the control performance were assigned "A", those which were difficult to be spun around and inferior in the control performance were assigned "C", and those which were in an intermediate range between them were assigned "B". Results of evaluation which gave a maximum convergence are presented in Table 6 and Table 7 below.

TABLE 6

| Results of evaluation | | | | | | | | |
|---|---|---|---|---|---|---|---|---|
| | Example 1 | Example 2 | Example 3 | Example 4 | Example 5 | Example 6 | Example 7 | Example 8 |
| Principal component of cover *1 | PU | PU | PU | PU | PU | PU | PU | PU |
| Hardness of mid layer Hm (Shore D) | 64 | 64 | 61 | 64 | 64 | 64 | 64 | — |
| Hardness of cover Hc (Shore D) | 42 | 47 | 47 | 42 | 42 | 42 | 42 | 47 |
| Difference (Hm − Hc) (Shore D) | 22 | 17 | 14 | 22 | 22 | 22 | 22 | — |
| Total number N | 410 | 410 | 410 | 410 | 410 | 410 | 410 | 410 |
| Number NL *2 | 330 | 330 | 330 | 330 | 330 | 330 | 330 | 330 |
| Number M *3 | 330 | 330 | 330 | 330 | 330 | 330 | 200 | 330 |
| Number ML *4 | 330 | 330 | 330 | 330 | 410 | 330 | 200 | 330 |
| (NL/N) · 100 (%) | 80.5 | 80.5 | 80.5 | 80.5 | 80.5 | 80.5 | 80.5 | 80.5 |
| (ML/NL) · 100 (%) | 100.0 | 100.0 | 100.0 | 100.0 | 100.0 | 100.0 | 60.6 | 100.0 |
| (M/N) · 100 (%) | 80.5 | 80.5 | 80.5 | 80.5 | 100.0 | 80.5 | 48.8 | 80.5 |
| Occupation ratio Y (%) | 84 | 84 | 84 | 84 | 84 | 84 | 84 | 84 |
| Total volume ($mm^3$) | 532 | 532 | 532 | 532 | 532 | 532 | 532 | 532 |
| Amount of compressive deformation (mm) | 2.9 | 2.8 | 2.8 | 2.9 | 2.9 | 2.9 | 2.9 | 2.9 |
| Travel distance (m) | 217.2 | 218.7 | 216.9 | 218.0 | 218.5 | 215.7 | 216.5 | 214.1 |

TABLE 6-continued

| Results of evaluation | Example 1 | Example 2 | Example 3 | Example 4 | Example 5 | Example 6 | Example 7 | Example 8 |
|---|---|---|---|---|---|---|---|---|
| Appearance | A | B | B | A | A | A | B | A |
| Control performance | A | A | A | A | A | A | A | A |

*1 PU: thermoplastic polyurethane elastomer, I0: Ionomer resin
*2 Number of dimples having a diameter of equal to or greater than 3.90 mm
*3 Number of dimples complying with the formula (1)
*4 Number of dimples having a diameter of equal to or greater than 3.90 mm, complying with the, formula (1) and having a radius of curvature Re of 2.0 mm or greater and 5.0 mm or less

TABLE 7

| Results of evaluation | Compara. Example 1 | Compara. Example 2 | Compara. Example 3 | Compara. Example 4 | Compara. Example 5 | Compara. Example 6 | Compara. Example 7 |
|---|---|---|---|---|---|---|---|
| Principal component of cover *1 | I0 | I0 | PU | PU | PU | PU | PU |
| Hardness of mid layer Hm (Shore D) | 61 | 64 | 64 | 64 | 64 | 64 | 64 |
| Hardness of cover Hc (Shore D) | 60 | 48 | 42 | 42 | 42 | 42 | 42 |
| Difference (Hm − Hc) (Shore D) | 1 | 16 | 22 | 22 | 22 | 22 | 22 |
| Total number N | 410 | 410 | 410 | 410 | 410 | 410 | 410 |
| Number NL *2 | 330 | 330 | 330 | 330 | 330 | 330 | 330 |
| Number M *3 | 330 | 330 | 0 | 330 | 0 | 330 | 0 |
| Number ML *4 | 330 | 330 | 0 | 0 | 0 | 0 | 0 |
| (NL/N) · 100 (%) | 80.5 | 80.5 | 80.5 | 80.5 | 80.5 | 80.5 | 80.5 |
| (ML/NL) · 100 (%) | 100.0 | 100.0 | 0.0 | 100.0 | 0.0 | 100.0 | 0.0 |
| (M/N) · 100 (%) | 80.5 | 80.5 | 0.0 | 80.5 | 0.0 | 80.5 | 0.0 |
| Occupation ratio Y (%) | 84 | 84 | 84 | 84 | 84 | 84 | 84 |
| Total volume ($mm^3$) | 532 | 532 | 532 | 532 | 532 | 532 | 532 |
| Amount of compressive deformation (mm) | 2.7 | 2.8 | 2.9 | 2.9 | 2.9 | 2.9 | 2.9 |
| Travel distance (m) | 219.5 | 216.3 | 212.0 | 215.8 | 212.3 | 211.0 | 215.6 |
| Appearance | D | E | C | C | A | A | C |
| Control performance | C | B | A | A | A | A | A |

*1 PU: thermoplastic polyurethane elastomer, I0: Ionomer resin
*2 Number of dimples having a diameter of equal to or greater than 3.90 mm
*3 Number of dimples complying with the formula (1)
*4 Number of dimples having a diameter of equal to or greater than 3.90 mm, complying with the formula (1) and having a radius of curvature Re of 2.0 mm or greater and 5.0 mm or less As is clear from Table 6 and Table 7, the golf ball of Examples is excellent in all terms of the flight performance, the scuff resistance performance and the control performance. Therefore, advantages of the present invention are clearly suggested by these results of evaluation.

The present invention can be applied also to two-piece golf balls, and golf balls having four or more layers. The description herein above is just for an illustrative example, therefore, various modifications can be made without departing from the principles of the present invention.

What is claimed is:

1. A golf ball having a core, a cover and numerous dimples formed on the surface of said cover, said cover comprising a polyurethane elastomer as a principal component, said cover having a Shore D hardness of 30 or greater and 55 or less, occupation ratio Y of total area of dimples to surface area of a phantom sphere being equal to or greater than 75%, proportion of the number NL of dimples having a diameter of equal to or greater than 3.90 mm to total number N of the dimples being equal to or greater than 75%, and proportion of the number ML of dimples having a diameter of equal to or greater than 3.90 mm, complying with the following formula (1) and having a radius of curvature Re of 2.0 mm or greater and 5.0 mm or less to the number NL being equal to or greater than 50%:

$$0.5 \leqq Re/Rw \leqq 1.5 \quad (1)$$

wherein Re represents a radius of curvature of a curved surface between a dimple edge and a point positioned downward from the dimple edge by the depth of 10% in an in-depth direction; and wherein Rw represents a radius of curvature of a curved surface between a point positioned downward from the dimple edge by the depth of 20% in an in-depth direction and a point positioned downward from the dimple edge by the depth of 50% in an in-depth direction.

2. The golf ball according to claim 1 wherein said proportion of the number ML to the number NL is 100%.

3. The golf ball according to claim 1 wherein the proportion of the number M of the dimples complying with said formula (1) to the total number N is equal to or greater than 90%.

4. The golf ball according to claim 1 wherein said core has a center, and a mid layer comprising a resin composition, with the hardness of said mid layer being greater than the hardness of the cover.

* * * * *